US009512692B2

(12) United States Patent
Nguyen et al.

(10) Patent No.: US 9,512,692 B2
(45) Date of Patent: Dec. 6, 2016

(54) RETRIEVABLE HORIZONTAL SPOOL TREE SEALING METHOD AND SEAL ASSEMBLY

(71) Applicant: Cameron International Corporation, Houston, TX (US)

(72) Inventors: Dennis P. Nguyen, Pearland, TX (US); Edward Nguyen, Houston, TX (US)

(73) Assignee: Cameron International Corporation, Houston, TX (US)

( * ) Notice: Subject to any disclaimer, the term of this patent is extended or adjusted under 35 U.S.C. 154(b) by 368 days.

(21) Appl. No.: 14/085,769

(22) Filed: Nov. 20, 2013

(65) Prior Publication Data

US 2015/0136426 A1 May 21, 2015

(51) Int. Cl.
*E21B 33/03* (2006.01)
*E21B 33/035* (2006.01)

(52) U.S. Cl.
CPC ..... *E21B 33/03* (2013.01); *E21B 33/035* (2013.01)

(58) Field of Classification Search
CPC ..... E21B 33/03; E21B 33/035; E21B 33/04; E21B 33/0415
See application file for complete search history.

(56) References Cited

U.S. PATENT DOCUMENTS 5,257,792 A * 11/1993 Putch ..... E21B 33/03 166/387
5,450,905 A 9/1995 Brammer et al.
2004/0104024 A1* 6/2004 Kent ..... E21B 33/0355 166/85.4
2008/0078555 A1 4/2008 Young et al.
2010/0194049 A1* 8/2010 Kocurek ..... E21B 33/03 277/314
2011/0017467 A1* 1/2011 June ..... E21B 33/043 166/368

FOREIGN PATENT DOCUMENTS

GB 2320937 A 7/1998

OTHER PUBLICATIONS

PCT International Search Report & Written Opinion; Application No. PCT/US2014/066222; mailed Nov. 3, 2015; 12 pages.

* cited by examiner

*Primary Examiner* — Brad Harcourt
(74) *Attorney, Agent, or Firm* — Fletcher Yoder, P.C.

(57) ABSTRACT

Embodiments of the present disclosure are directed toward a seal assembly comprising a main body comprising a production fluid port configured to align with a production fluid bore of a tubing spool of a mineral extraction system, a first annular seal supported by the main body and disposed on a first side of the production fluid port, and a second annular seal supported by the main body and disposed on a second side of the production fluid port, wherein the seal assembly is configured to be disposed in an annular region between a hanger and the tubing spool of the mineral extraction system, the first annular seal and the second annular seal are configured to isolate the production fluid port from the annular region, and the seal assembly is configured to be removed from the tubing spool without the hanger.

20 Claims, 9 Drawing Sheets

RETRIEVABLE HORIZONTAL SPOOL TREE SEALING METHOD AND SEAL ASSEMBLY

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are often employed to access and extract the resource. These systems can be located onshore or offshore depending on the location of a desired resource. Further, such systems generally include a wellhead assembly through which the resource is extracted. These wellhead assemblies generally include a wide variety of components and/or conduits, such as various control lines, casings, valves, and the like, that control drilling and/or extraction operations.

In drilling and extraction operations, various components and tools, in addition to and including wellheads, are employed to provide for drilling, completion, and production of a mineral resource. Further, during drilling and extraction operations, one or more seals may be employed to regulate pressures and the like. For instance, a wellhead system often includes a tubing hanger or casing hanger that is disposed within the wellhead assembly and configured to secure tubing and casing suspended in the well bore. The hanger generally provides a path for hydraulic control fluid, chemical injections, or the like to be passed through the wellhead and into the well bore. Additionally, the tubing hanger provides a path for production fluid to be passed through the wellhead and exit the wellhead through a production flow bore to an external production flow line. Accordingly, the hanger may include seals that are compressed between a body of the hanger and a component of the wellhead (e.g., a tubing spool) to seal off an annular region between the hanger and the wellhead. For example, the seals may be disposed about the production flow bore to isolate the production flow bore from annular region between the hanger and the wellhead. The seals generally prevent pressures of the production flow bore from manifesting through the wellhead. Typically, the seals are integrated with the hanger. As a result, seal replacement involves removing the hanger from the wellhead, which involves the use of a derrick, blowout preventers, and other equipment that is expensive to use and operate.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Embodiments of the present technique include a system and method that addresses one or more of the above-mentioned inadequacies of conventional systems and methods of sealing. As explained in greater detail below, the disclosed embodiments include a sealing assembly configured to isolate a production flow bore from an annular region between a hanger (e.g., a casing hanger or tubing hanger) and a component of a wellhead (e.g., a tubing spool or tree). More specifically, the sealing assembly is configured to be installed and removed independently of the spool tree and the hanger. As a result, the sealing assembly may be removed and seals of the sealing assembly may be repaired or replaced without removing the hanger from the spool tree wellhead system. For example, after the hanger is installed within the spool tree wellhead, the seal assembly may be threaded about the hanger in the annular region between the hanger and the spool tree. Similarly, the seal assembly may be removed from the spool tree by unthreading the seal assembly from the hanger, while the hanger remains in place within the spool tree. As described in detail below, the seal assembly and/or other components of the spool tree (e.g., hanger, spool, etc.) may have additional features to enable the installation and removal of the seal assembly from the spool tree without removing the hanger from the wellhead.

Figure 1:
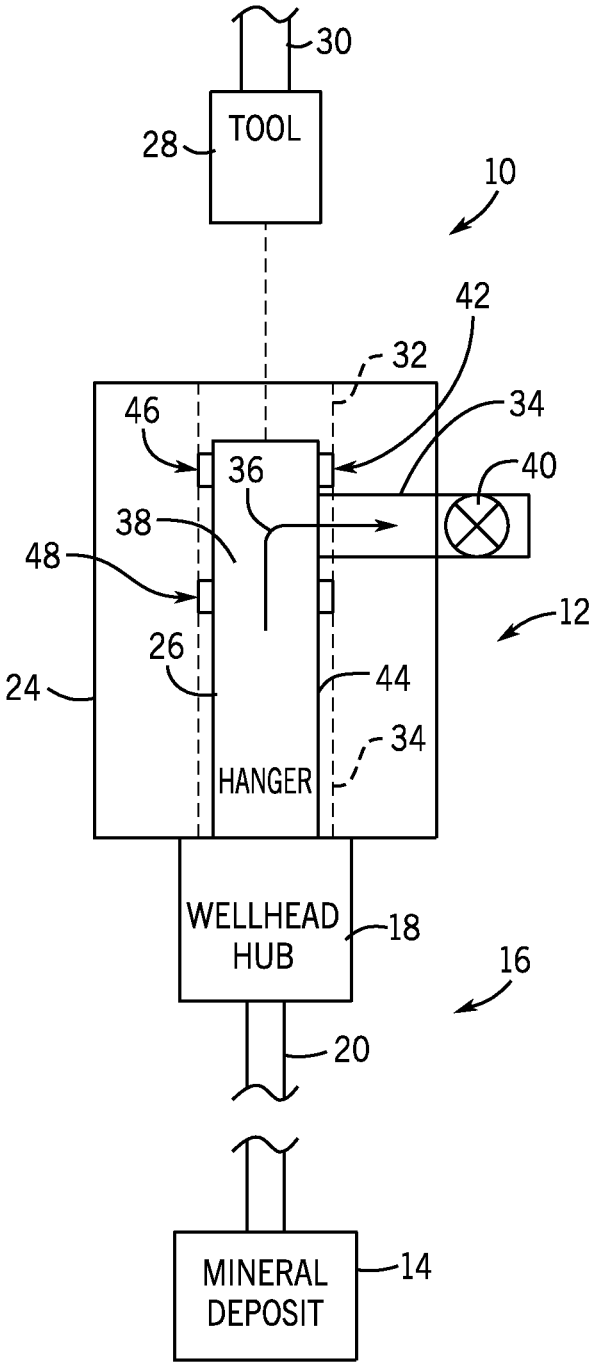
FIG. 1 is a block diagram that illustrates a mineral extraction system, in accordance with an embodiment of the present disclosure.

FIG. 1 illustrates a mineral extraction system 10. The illustrated mineral extraction system 10 can be configured to extract various minerals and natural resources, including hydrocarbons (e.g., oil and/or natural gas), for instance. Further, the system 10 may be configured to inject substances. In some embodiments, the mineral extraction system 10 is land-based (e.g., a surface system) or subsea (e.g., a subsea system). As illustrated, the system 10 includes a wellhead 12 coupled to a mineral deposit 14 via a well 16. For example, the well 16 includes a wellhead hub 18 and a well-bore 20.

The wellhead hub 18 may include a large diameter hub that is disposed at the termination of the well bore 20 near the surface. Thus, the wellhead hub 18 may provide for the connection of the wellhead 12 to the well 16. In the illustrated system 10, the wellhead 12 is disposed on top of the wellhead hub 18. The wellhead 12 may be coupled to a connector of the wellhead hub 18, for instance. In one embodiment, the wellhead hub 18 includes a DWHC (Deep Water High Capacity) hub manufactured by Cameron, headquartered in Houston, Tex. Accordingly, the wellhead 12 may include a complementary connector. For example, in one embodiment, the wellhead 12 includes a collet connector (e.g., a DWHC connector), also manufactured by Cameron.

The wellhead 12 generally includes a series of devices and components that control and regulate activities and conditions associated with the well 16. For example, the wellhead 12 may provide for routing the flow of produced minerals from the mineral deposit 14 and the well bore 20, provide for regulating pressure in the well 16, and provide for the injection of chemicals into the well bore 20 (down-hole). In the illustrated embodiment, the wellhead 12 includes a tubing spool tree 24 (e.g., a tubing spool or a horizontal tubing spool tree) and a hanger 26 (e.g., a tubing hanger or a casing hanger). The system 10 may also include devices that are coupled to the wellhead 12, and those that are used to assemble and control various components of the wellhead 12. For example, in the illustrated embodiment, the system 10 also includes a tool 28 suspended from a drill string 30. In certain embodiments, the tool 28 may include running tools that are lowered (e.g., run) from an offshore vessel to the well 16, the wellhead 12, and the like.

The tubing spool tree 24 generally includes a variety of flow paths (e.g., bores), valves, fittings, and controls for operating the well 16. For instance, the tubing spool tree 24 may include a frame that is disposed about a body, a flow-loop, actuators, and valves. Further, the tubing spool tree 24 may provide fluid communication with the well 16. For example, the illustrated tubing spool tree 24 includes a spool bore 32. The spool bore 32 may provide for completion and workover procedures, such as the insertion of tools (e.g., the hanger 26) into the well 16, the injection of various chemicals into the well 16 (down-hole), and the like. Further, minerals extracted from the well 16 (e.g., oil and natural gas) may be regulated and routed via the tubing spool tree 24. For instance, the tubing spool tree 24 includes a horizontal production flow bore 34 configured to enable a flow of produced minerals from the well 16 to shipping or storage facilities, as indicated by arrow 36. More specifically, the horizontal production flow bore 34 is in fluid communication with a tubing hanger bore 38 that is fluidly connected to the wellbore 20. Thus, produced minerals may flow from the well bore 20, through the tubing hanger bore 38, and through the production fluid bore 34. A flow of produced minerals may be regulated by a production flow valve 40 disposed along the production fluid bore 34. The tubing hanger bore 38 may also provide access to the well bore 20 for various completion and worker procedures. For example, components may be run down to the wellhead 12 and disposed in the tubing hanger bore 34 to seal-off the well bore 20, to inject chemicals down-hole, to suspend tools down-hole, to retrieve tools down-hole, and the like.

As will be appreciated, mineral extractions systems 10 are often exposed to extreme conditions. For example, during drilling and production of a well 16, the well bore 20 may include pressures up to and exceeding 10,000 pounds per square inch (PSI). Accordingly, mineral extraction systems 10 generally employ various mechanisms, such as seals and valves, to control and regulate the well 16. For instance, the hanger 26 (e.g., tubing hanger or casing hanger) that is disposed within the wellhead 12 secures tubing and casing suspended in the well bore 20, and provides a path for hydraulic control fluid, chemical injections, and the like to be passed down-hole. Accordingly, the hanger 26 may include a seal assembly 42 that is disposed in an annular region 44 between a body of the hanger 26 and the wellhead 12 (e.g., the tubing spool tree 24), to seal off the annular region 44 from the production flow bore 34. More specifically, the seal assembly 42 includes an upper seal 46 and a lower seal 48 that are disposed about the production flow bore 34. In other words, when the seal assembly 42 is installed within the annular region 44 between the hanger 26 and the tubing spool tree 24, the upper seal 46 is disposed on a first side of the production flow bore 34, and the lower seal 48 is disposed on a second side of the production flow bore 34. As discussed in detail below, the upper and lower seals 46 and 48 may be elastomeric seals, metal seals, metal end cap seals, or other suitable seals. The seal assembly 42 may block pressures in the production flow bore 34 from manifesting through the wellhead 12 (e.g., within the annular region 44), and enable regulation of the pressure in the annular region and the well 16.

As described in detail below, the seal assembly 42 may be provided as a component that is independently installed and seated after the hanger 26 has been landed in the wellhead 12 (e.g., the tubing spool tree 24). In other words, the hanger 26 may be run down to the subsea wellhead 12, followed by the installation of the seal assembly 42. Installation of the seal assembly 42 may include procedures, such as threading and seating the seal assembly 42 about the hanger 26. Accordingly, installation of the seal assembly 42 may include the use of several tools 28 and procedures to install the seal assembly 42. For example, the seal assembly 42 may be run from a drilling vessel to the wellhead 12 via a seal running tool 28 attached to the drill stem 30 by manually or hydraulically threading the seal assembly 42 about the tubing hanger 26. Similarly, as described below, the seal assembly 42 may be uninstalled (e.g., removed from the tubing spool tree 24) by the running tool 28 independently of the hanger 26 and tubing spool tree 24. For example, the seal assembly 42 may be unthreaded and removed from the tubing spool tree 24 without removing the hanger 26 from the tubing spool tree 24. As a result, a drilling rig may not be used during removal of the seal assembly 42, thereby decreasing costs associated with removal, maintenance, and replacement of the seal assembly 42 and its components.

Figure 2:
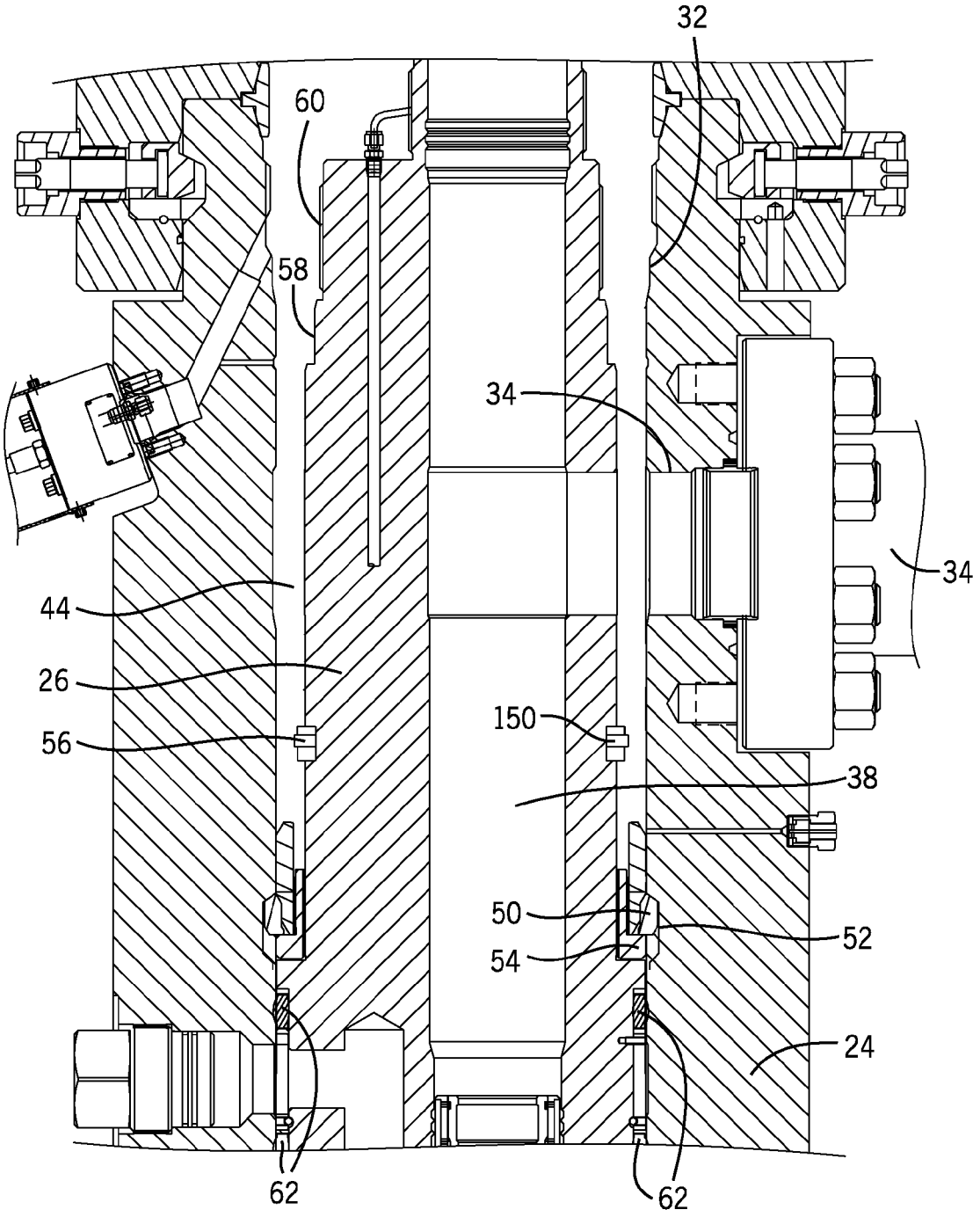
FIG. 2 is a cross-section of a wellhead assembly with a tubing hanger and a tubing spool, in accordance with an embodiment of the present disclosure.

FIG. 2 is a cross-section of the hanger 26 installed and seated within the tubing spool tree 24. In the illustrated embodiment, the seal assembly 42 is not shown. As mentioned above, the seal assembly 42 may be installed and removed from the tubing spool tree 24 without removing the hanger 26 from the tubing spool tree 24. Accordingly, the hanger 26 may be installed and locked in place within the tubing spool tree 24. To this end, the hanger 26 includes a locking ring 50 that engages with a recess 52 of the tubing spool tree 24 when the hanger 26 is installed and locked within the tubing spool bore 32. For example, the locking ring 50 may be an annular, outwardly biased ring that is held in a radially expanded state by a bottom ring 54 when the hanger 26 is installed. As will be appreciated, when the locking ring 50 is engaged with the recess 52, the locking ring 50 blocks axial movement of the hanger 26 within the tubing spool tree 24. Therefore, when the seal assembly 42 is installed into and removed from the tubing spool tree 24, the hanger 26 may remain fixed and sealed in place within the tubing spool tree 24.

The hanger 26 further includes a load ring 56 (e.g., a split ring), which is configured to engage with the seal assembly 42 when the seal assembly 42 is installed within the annular region 44 between the hanger 26 and the tubing spool tree 24. More specifically, when the seal assembly 42 is installed into the annular region 44 between the hanger 26 and the tubing spool tree 24, the seal assembly 42 may axially abut the load ring 56, and the load ring 56 may block the seal assembly 42 from axially translating downward beyond the load ring 56. In certain embodiments, when the load ring 56 blocks axial movement of the seal assembly 42 beyond the load ring 56, actuation (e.g., threading) of the seal assembly 42 may cause seals of the seal assembly 42 to become compressed or loaded.

As mentioned above, the seal assembly 42 is configured to be disposed within the annular region 44 between the hanger 26 and the tubing spool tree 24. For example, the seal assembly 42 may be installed within the annular region 44 by threading the seal assembly 42 about the hanger 26. To this end, an outer diameter 58 of the hanger 26 includes a threaded portion 60, which is configured to engage with a corresponding threaded portion of the seal assembly 42. In certain embodiments, the seal assembly 42 may be threaded about the hanger 26 manually (e.g., via manual actuator) or hydraulically (e.g., via hydraulic actuator).

The illustrated embodiment of the tubing spool tree 24 and the hanger 26 may include other features and components. For example, seals 62 may be included between the tubing spool tree 24 and the hanger 26 to further isolate the annular region 44 from other portions of the wellhead 12. The seals 62 may be permanent seals (e.g., the seals remain in place) that isolate pressure within the wellhead 12 (e.g., between the hanger 26 and the tubing spool tree 24) when the seal assembly 42 is removed and/or replaced. In certain embodiments, the seals 62 may be elastomeric seals, metal end cap seals, metal seals, or other suitable seals.

Figure 3:
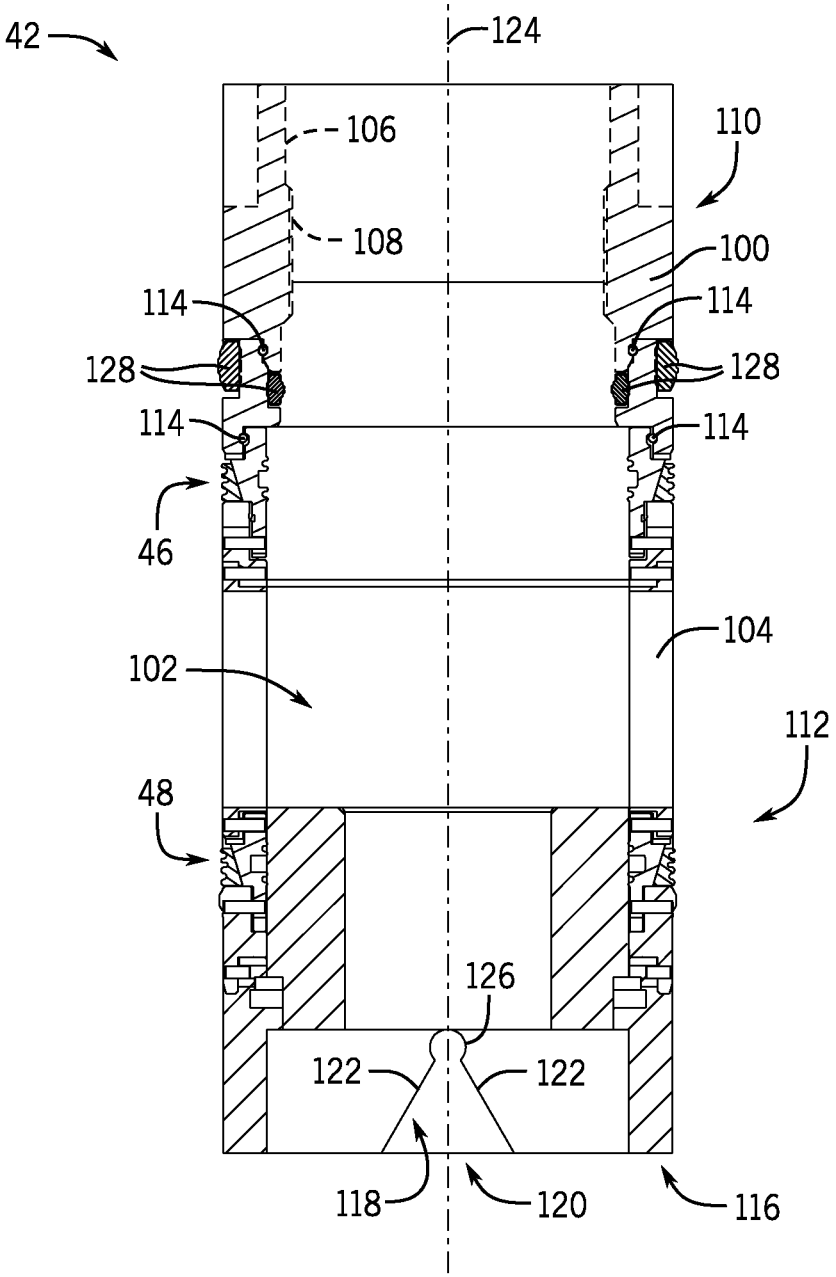
FIG. 3 is a cross-section of an embodiment of a seal assembly, in accordance with an embodiment of the present disclosure.

FIG. 3 is a cross-section of an embodiment of the seal assembly 42. As shown, the seal assembly 42 includes a main body 100 (e.g., seal carrier) that supports the upper seal 46 and the lower seal 48. In certain embodiments, the main body 100 may be formed from a metal, such as steel, aluminum, or other metal suitable for use in subsea environments. The main body 100 has a generally annular configuration, as the seal assembly 42 is configured to be disposed about the hanger 26 when the seal assembly 42 is installed within the tubing spool tree 24. As such, the main body 100 defines a central passage 102 that is occupied by the hanger 26 when the seal assembly 42 is installed within the tubing spool tree 24. Additionally, the main body 100 includes a production flow port 104 that is configured to be aligned with the production flow bore 34 of the wellhead 12 and a production flow port of the hanger 26. In other words, when the seal assembly 42 is installed within the tubing spool tree 24, the production flow port 104 is fluidly coupled to the production flow bore 34 of the wellhead 12 and a production flow port of the hanger 26 to enable a flow of produced minerals from the well 16, through the hanger 26 and into the production flow bore 34.

The upper and lower seals 46 and 48 are positioned on axially opposite sides of the production flow port 104 of the seal assembly 42, and the upper and lower seals 46 and 48 are configured to engage with the hanger 26 and the tubing spool tree 24. As a result, the upper and lower seals 46 and 48 may isolate the production flow port 104 and the production flow bore 34 from the annular region 44 between the hanger 26 and the tubing spool tree 24. In the illustrated embodiment, the upper and lower seals 46 and 48 are metal seals. The metal seals are described in further detail below with respect to FIG. 5.

As mentioned above, the seal assembly 42 is configured to be disposed about the hanger 26 when the seal assembly 42 is installed within the tubing spool tree 24, and the seal assembly 42 is configured to be threaded about the outer diameter 58 of the hanger 26. To this end, an inner diameter 106 of the seal assembly 42 (e.g., the main body 100) includes a threaded portion 108 that is configured to engage with the threaded portion 60 of the hanger 26. As will be appreciated, to engage the threaded portion 108 of the seal assembly 42 with the threaded portion 60 of the hanger 26, the seal assembly 42 (e.g., the main body 100) is rotated relative to the hanger 26 when the seal assembly 42 is disposed within the tubing spool tree 24. Accordingly, the main body 100 of the seal assembly 42 includes a rotatable portion 110 and a stationary portion 112. Ball bearings 114 are disposed between the rotatable portion 110 and the stationary portion 112 to enable rotation of the rotatable portion 110 while the stationary portion 112 may not rotate. It should be noted that the ball bearings 114 reduce the rotational motion of the rotatable portion 110 that is transferred to the stationary portion 112, but may not completely block all rotational movement transferred to the stationary portion 112. The stationary portion 112 may still rotate in certain circumstances, such as during alignment of the seal assembly 42 during installation, as described below.

To install the seal assembly 42, a first end 116 (e.g., a bottom end) of the seal assembly 42 is first positioned (e.g., by tool 28) into the tubing spool tree 24 (e.g., into the tubing spool bore 32) about the hanger 26. The seal assembly 42 may also be positioned such that the production flow port 104 of the main body 100 is on the same side of the tubing spool tree 24 as the production flow bore 34 of the wellhead 12. Once the threaded portion 108 of the seal assembly 42 contacts the threaded portion 60 of the hanger 26, the rotatable portion 110 of the seal assembly 42 may be rotated (e.g., manually or hydraulically), thereby engaging the threaded portion 108 of the seal assembly 42 with the threaded portion 60 of the hanger 26. As the threaded portions 108 and 60 engage with one another, the seal assembly 42 will travel axially downward within the annular region 44 of the wellhead 12 until the first end 116 of the seal assembly 42 abuts the load ring 56 of the hanger 26.

As mentioned above, the ball bearings 114 of the seal assembly 42 enable the rotatable portion 110 of the seal assembly 42 to be rotated while the stationary portion 112 does not rotate during installation of the seal assembly 42. As such, if the production flow port 104 of the seal assembly 42 is aligned on the same side of the wellhead 12 as the production flow bore 34 at the beginning of the seal assembly 42 installation, the production flow port 104 should be in fluid communication with the production flow bore 34 when the seal assembly 42 is landed against the load ring 56 of the hanger 26. To further enable alignment of the production flow port 104 and the production flow bore 34 when the seal assembly 42 is installed, the main body 100 of the seal assembly 42 includes an alignment slot 118. More specifically, the alignment slot 118 is formed in the stationary portion 112 of the main body 100 at the first end 116 of the seal assembly 42. During installation of the seal assembly 42, the alignment slot 118 is configured to engage with an alignment pin 150 of the hanger 26. The alignment slot 118 includes a wide mouth 120 that captures the alignment pin 150 as the seal assembly 42 travels axially downward in the annular region 44 during installation of the seal assembly 42. During installation, the alignment pin 150 may engage with angled surfaces 122 of the alignment slot 118. As the alignment pin 150 engages with the angle surfaces 122, the position of the seal assembly 42 may be slightly adjusted (e.g., rotated about a central axis 124 of the seal assembly 42). Once the alignment pin 150 engages with a notch 126 of the alignment slot 118, the production flow port 104 of the seal assembly 42 may be aligned and in fluid communication with the production flow bore 34 of the wellhead 12.

As shown, the seal assembly 42 includes additional features and components, such as test seals 128. The test seals 128 are annular seals that are positioned along the inner diameter 106 of the main body 100 and an outer diameter 130 of the main body 100 of the seal assembly 42. The test seals 128 may further isolate the annular region 44 from other sections or areas of the wellhead 12 from elevated pressures. In the illustrated embodiment, the test seals 128 are metal end cap seals. However, in other embodiments, the test seals 128 may be metal seals, elastomeric seals, or other seals.

Figure 4:
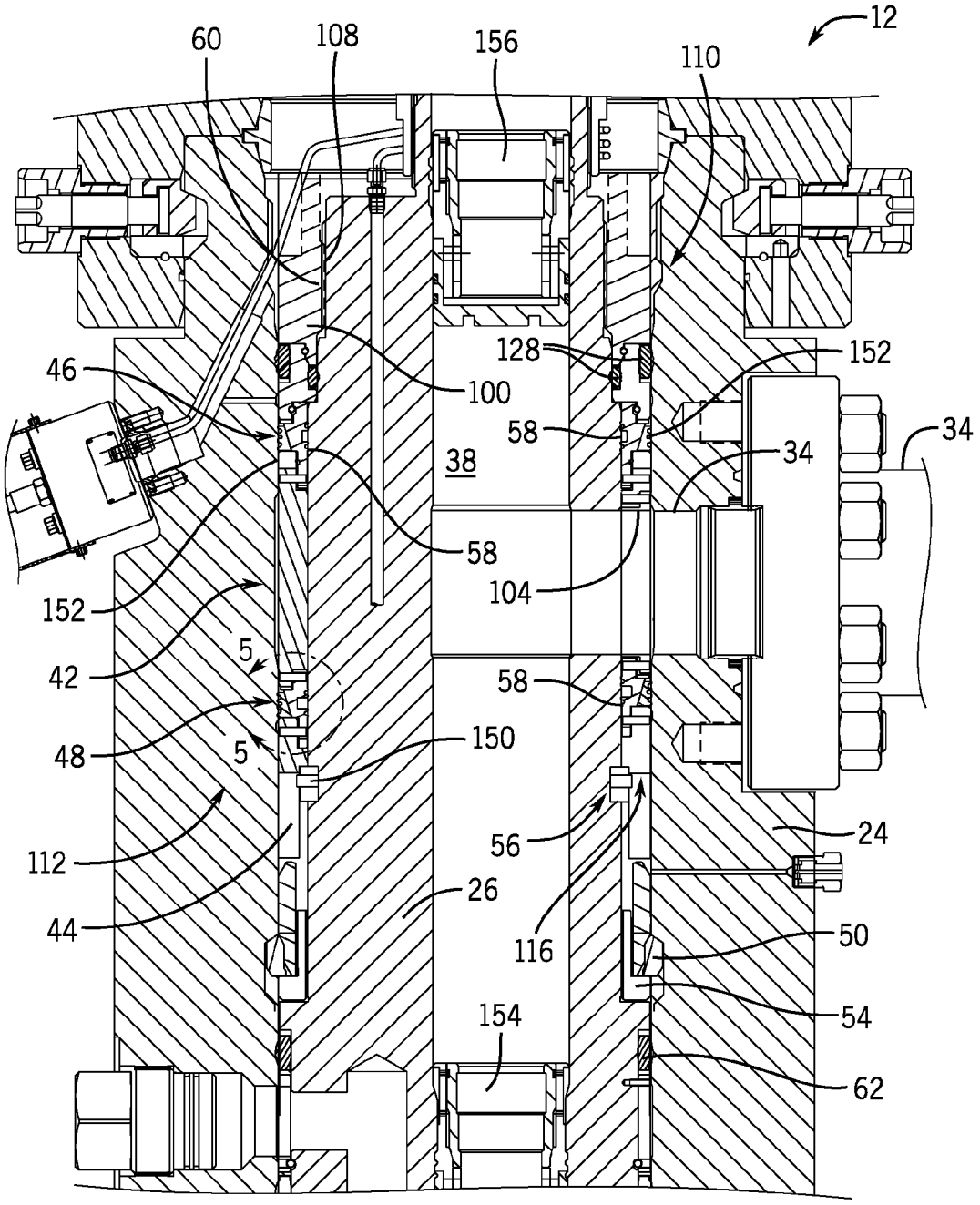
FIG. 4 is a cross-section of an embodiment of the seal assembly disposed within the tubing spool, in accordance with an embodiment of the present disclosure.

FIG. 4 is a cross-section of an embodiment of the wellhead 12, illustrating the seal assembly 42 disposed in the annular region 44 between the hanger 26 and the tubing spool tree 24. As discussed above, the seal assembly 42 is a separate component that is installed within the tubing spool tree 24 independently of the hanger 26. Specifically, after the hanger 26 is installed, landed, and locked (e.g., by lock ring 50) within the tubing spool tree 24, the seal assembly 42 is installed within the annular region 44 by threading the seal assembly 42 about the hanger 26. More particularly, the threaded portion 108 of the inner diameter 106 of the seal assembly 42 is engaged with the threaded portion 60 of the outer diameter 58 of the hanger 26. Additionally, as discussed above, the alignment slot 118 of the seal assembly 42 may capture an alignment pin 150 of the hanger 26 to enable alignment of the production flow port 104 and the production flow bore 34. Once the seal assembly 42 is installed and landed against the load ring 56 of the hanger 26, the upper seal 46 is disposed on a first side of the production flow bore 34 and the lower seal 48 is disposed on a second side of the production flow bore 34. As a result, the production flow bore 34 is isolated from the annular region 44, thereby isolating pressures within the well 16 and the production flow bore 34 from other areas of the wellhead 12.

In the illustrated embodiment, the upper and lower seals 46 and 48 are metal seals. As shown, each of the upper and lower seals 46 and 48 forms a sealing interface with the outer diameter 58 of the hanger 26 and an inner diameter 152 of the tubing spool tree 24. The operation of the metal seals in the illustrated embodiment is described in further detail below with respect to FIG. 5.

The seal assembly 42 may be removed in a manner similar to the installation of the seal assembly 42. That is, the seal assembly 42 may be unthreaded from the hanger 26 by the tool 28 or other mechanism. For example, the seal assembly 42 may be unthreaded manually or hydraulically. Further, the seal assembly 42 may be unthreaded without removal of the hanger 26. Instead, the hanger 26 may remain locked (e.g., by lock ring 50) within the tubing spool tree 24 when the seal assembly 42 is removed (e.g., to repair or replace the upper and/or lower seals 46 and/or 48). As such, the seal assembly 42 may be removed without the use of a drilling rig, blow out preventer, or other equipment that is costly to operate. During removal of the seal assembly 42, the hanger bore 38 may be plugged with a seal plug 154 to block produced minerals from exiting the wellhead 12. After the seal assembly 42 is replaced or installed back in the annular region 44, a plug 156 may be positioned within the hanger bore 38 to enable produced minerals to flow through the production flow bore 34 and block produced minerals from exiting the top of the wellhead 12.

Figure 5:
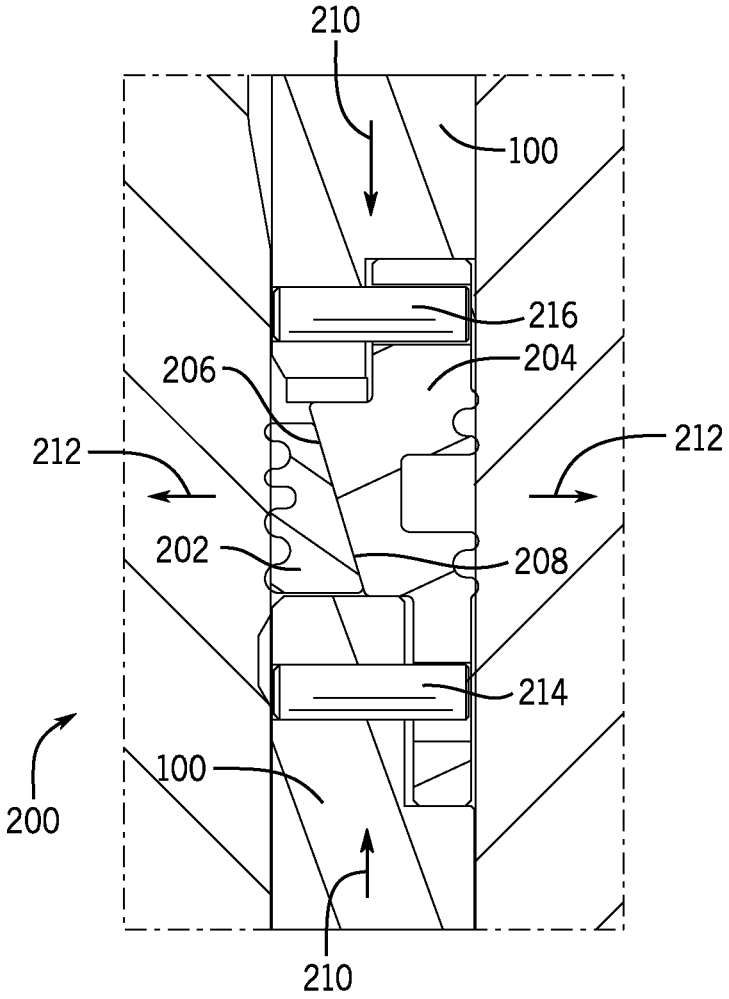
FIG. 5 is a cross-section of a seal of the seal assembly shown in FIG. 4, in accordance with an embodiment of the present disclosure.

FIG. 5 is a cross-section of the lower seal 48, taken within line 5-5 of FIG. 4, where the lower seal 48 is a metal seal 200 (e.g., a metal-to-metal seal). For example, the metal seal 200 may be a CANH seal (available from Cameron International Corporation, Houston, Tex.). As will be appreciated, disclosed embodiments demonstrate setting the exemplary CANH seal; however, other metal-to-metal seals may be set using the described seal assembly 42. As illustrated in FIG. 5, the metal seal 200 includes two concentric metal ring components 202 and 204. The components 202 and 204 may have a generally wedge-shaped cross-section, as illustrated in FIG. 5. Complimentary frusto-conical surfaces 206 and 208 on the ring components 202 and 204, respectively, may enable the components 202 and 204 to fit together (e.g., wedge together) to form the metal-to-metal seal 200.

As described above, the seal 200 may be disposed between the inner diameter 152 of the tubing spool tree 24 and the outer diameter of the hanger 26. By applying axial force or pressure to the seal 200 (i.e., along the lines 210), the components 202 and 204 are pressed together and expand radially (i.e., along the lines 212). Specifically, when the seal assembly 42 is landed against the load ring 56 of the hanger 26, further downward axial movement of the seal assembly 42 is blocked, and the main body 100 of the seal assembly 42 may force or apply the axial pressure to the components 202 and 204 of the metal seal 200. In the illustrated embodiment, the metal seal 200 further includes a shear pin 214, which is configured to shear when the axial force or pressure acting on the metal seal 200 exceeds a threshold, and a dow pin 216, which is configured to couple the metal seal 200 to the main body 100. When the shear pin 214 shears upon application of the threshold axial pressure, the ring components 202 and 204 radially expand between the hanger 26 and tubing spool tree 24 to generate a secure metal sealing interface between the hanger 26 and the tubing spool tree 24. In the illustrated embodiment, the metal seal 200 has one shear pin 214. However, in other embodiments, the metal seal 200 may have two shear pin 214 or more. Furthermore, the shear pins 214 for different metal seals 200 (e.g., the upper seal 46 and the lower seal 48) may have different shearing thresholds. Accordingly, the different metal seals 200 may radially expand upon the application of different axial forces. For example, in the embodiment shown in FIG. 4, the shear pin 214 of the lower seal 48 may have a lower shearing threshold, thereby enabling the lower seal 48 to radially expand and set first, and the shear pin 214 of the upper seal 46 may have a higher shearing threshold, thereby enabling the upper seal 46 to radially expand and set second. In this manner, the upper and lower seals 46 and 48 may be set independently of one another.

Figure 6:
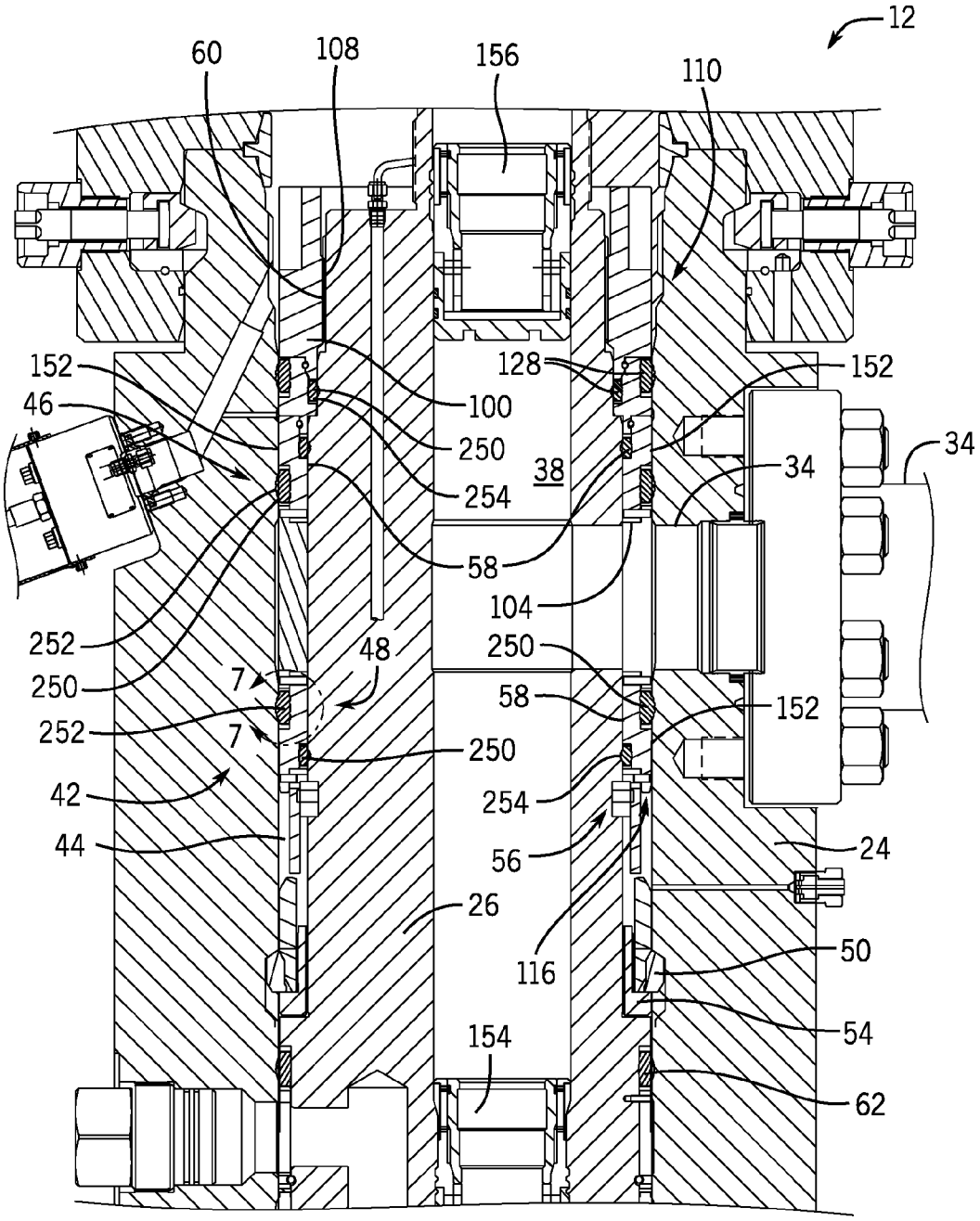
FIG. 6 is a cross-section of an embodiment of the seal assembly disposed within the tubing spool, in accordance with an embodiment of the present disclosure.
Figure 7:
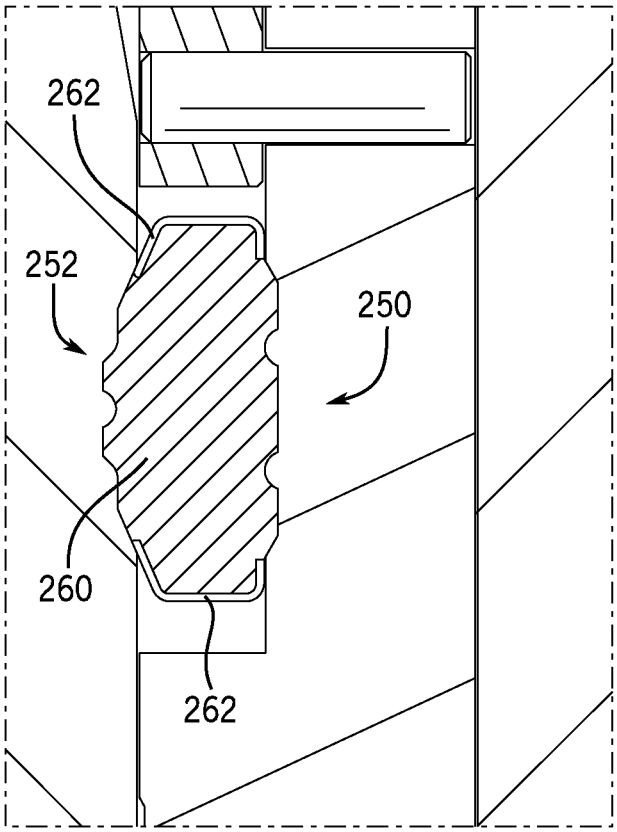
FIG. 7 is a cross-section of a seal of the seal assembly shown in FIG. 6, in accordance with an embodiment of the present disclosure.

FIG. 6 is a cross-section of an embodiment of the seal assembly 42, where the upper and lower seals 46 and 48 include metal end cap seals 250. Specifically, each of the upper and lower seals 46 and 48 includes a first metal end cap seal 252 (e.g. annular metal end cap seals) disposed between the main body 100 of the seal assembly 42 and the inner diameter 152 of the tubing spool tree 24 and a second metal end cap seal 254 disposed between the outer diameter 58 of the hanger 26 and the main body 100 of the seal assembly 42. However, in other embodiments, the upper and lower seals 46 and 48 may have metal end cap seals 250 positioned in different configurations. FIG. 7 is a cross-section of the first metal end cap seal 252 of the lower seal 48, taken within line 7-7 of FIG. 6. As shown in FIG. 7, the metal end cap seal 250 includes an annular elastomeric seal body 260 that is radially squeezed by metal end caps or shells 262 (e.g., stainless steel end caps).

Figure 8:
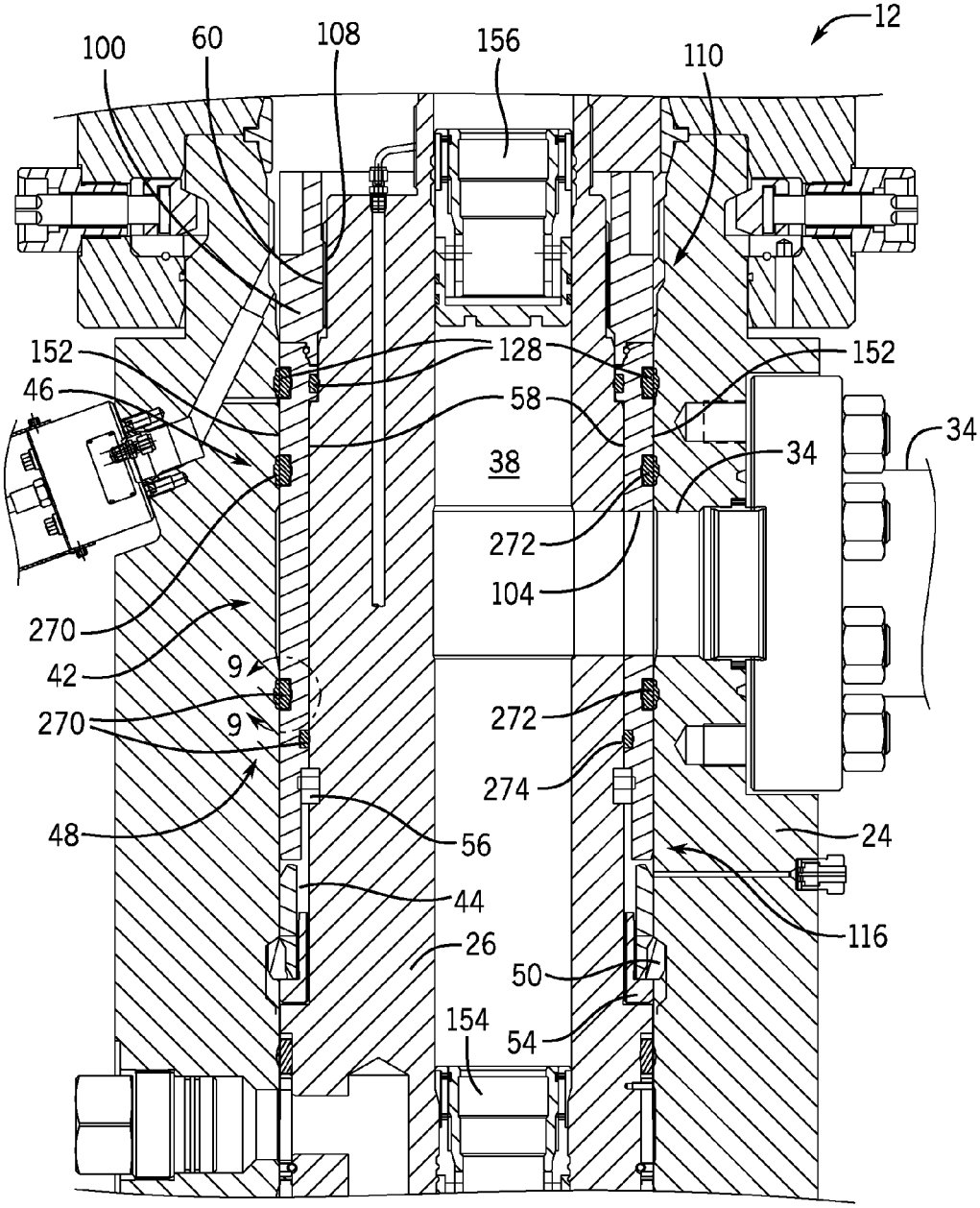
FIG. 8 is a cross-section of an embodiment of the seal assembly disposed within the tubing spool, in accordance with an embodiment of the present disclosure.
Figure 9:
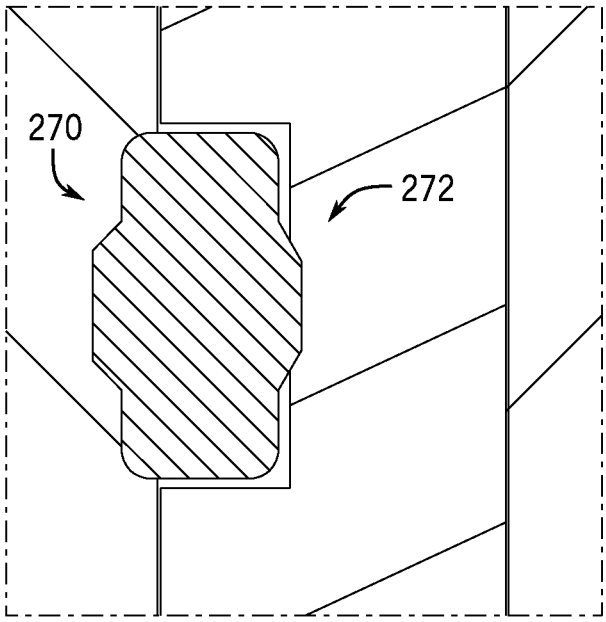
FIG. 9 is a cross-section of a seal of the seal assembly shown in FIG. 8, in accordance with an embodiment of the present disclosure.

FIG. 8 is a cross-section of an embodiment of the seal assembly 42, where the upper and lower seals 46 and 48 include elastomer seals 270. Specifically, each of the upper and lower seals 46 and 48 includes a first elastomer seal 272 disposed between the main body 100 of the seal assembly 42 and the inner diameter 152 of the tubing spool tree 24. Additionally, the lower seal 48 includes a second elastomer seal 274 disposed between the outer diameter 58 of the hanger 26 and the main body 100 of the seal assembly 42. However, in other embodiments, the upper and lower seals 46 and 48 may have elastomer seals 270 positioned in different configurations. FIG. 9 is a cross-section of the first elastomer seal 272 of the lower seal 48, taken within line 9-9 of FIG. 8. The elastomer seal 270 may have an annular configuration and may be configured to be disposed within a seal recess of the main body 100 of the seal assembly 42. The elastomer seal 270 may also have material properties that enable the elastomer seal 270 to deform and/or engage with the tubing spool tree 24 or the hanger 26 to generate a secure sealing interface.

As will be appreciated, the disclosed embodiments of the seal assembly 42 may include different combinations and/or different configurations for each of the upper and lower seals 46 and 48. For example, in one embodiment, the upper seal 46 may include metal seals 200, and the lower seal 48 may include metal end cap seals 250. In other words, the different seals described above (e.g., metal seals 200, metal end cap seals 250, and elastomer seals 270) may be interchangeable with one another in the seal assembly 42. Furthermore, each of the seals included with the upper and lower seals 46 and 48 may be removed from the main body 100 of the seal assembly 42, as desired. For example, the upper and lower seals 46 and 48 may be removed, repaired, and/or replaced, as desired. Indeed, the disclosed embodiments are directed towards the seal assembly 42, which may be installed and removed from the tubing spool tree 24 independently from the tubing spool tree 24 and the hanger 26. In other words, the seal assembly 42 may be installed after the hanger 26 is run, landed, and locked into the tubing spool tree 24 (e.g., by the locking ring 50). For example, the seal assembly 42 may be disposed within the annular region 44 between the hanger 26 and the tubing spool tree 24, and the seal assembly 42 may be threadably engaged with the hanger 26. Similarly, to remove the sealing assembly 42 from the tubing spool tree 24, the sealing assembly 42 may be unthreaded from the hanger 26 and removed from the annular region 44. Indeed, the sealing assembly 42 may be removed without retrieving the hanger 26 from the tubing spool 26 and without the use of a drilling rig. As a result, the costs associated with repairing and/or replacing the upper and lower seals 46 and 48, which isolate the production flow bore 34 from the annular region 44 and other sections of the wellhead 12, may be reduced.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A mineral extraction system, comprising:

a hanger configured to support casing or tubing; and a seal assembly comprising:

a main body comprising a production fluid port, a first portion, and a second portion, wherein the first portion is moveable relative to the second portion during installation and/or removal of the seal assembly in and/or from the mineral extraction system;

a first annular seal supported by the main body and disposed on a first side of the production fluid port; and a second annular seal supported by the main body and disposed on a second side of the production fluid port, wherein the seal assembly is configured to be disposed in an annular region between the hanger and a tubing spool of a mineral extraction system, the first annular seal and the second annular seal are configured to isolate the production fluid port from the annular region, and the seal assembly is removably coupled to the hanger.

2. The system of claim 1, wherein the seal assembly and the hanger are in threaded engagement with one another.

3. The system of claim 1, wherein the hanger comprises a locking ring configured to engage with a recess of the tubing spool.

4. The system of claim 1, wherein the first annular seal comprises a first metal-to-metal seal, and the second annular seal comprises a second metal-to-metal seal.

5. The system of claim 1, wherein the main body comprises an alignment slot configured to engage with an alignment pin of the hanger, and wherein the alignment slot enables alignment of the production fluid port with a production fluid bore of the tubing spool.

6. The system of claim 5, wherein the alignment slot comprises:

a wide mouth configured to capture the alignment pin;

a notch configured to engage with the alignment pin; and a plurality of angled surfaces configured to guide the alignment pin to the notch.

7. The system of claim 1, wherein the first portion comprises a threaded portion of an inner diameter of the main body, the first portion is rotatable during installation and/or removal of the seal assembly in and/or from the mineral extraction system, the second portion comprises the first annular seal and the second annular seal, the second portion is stationary during installation and/or removal of the seal assembly in and/or from the mineral extraction system, and the main body comprises a plurality of ball bearings disposed between the first portion and the second portion.

8. The system of claim 1, wherein the first annular seal comprises a first metal end cap seal, and the second annular seal comprises a second metal end cap seal.

9. The system of claim 1, wherein the first annular seal comprises a first elastomer seal, and the second annular seal comprises a second elastomer seal.

10. A method, comprising:

running a hanger in a horizontal tubing spool tree of a mineral extraction system;

landing the hanger in the horizontal tubing spool tree of the mineral extraction system;

positioning a seal assembly within an annular region between the hanger and the horizontal tubing spool tree of the mineral extraction system, wherein positioning the seal assembly within the annular region comprises positioning a first annular seal on a first side of a production flow bore of the horizontal tubing spool tree and positioning a second annular seal on a second side of the production flow bore of the horizontal tubing spool tree, wherein positioning the seal assembly within the annular region comprises moving a first portion of a main body of the seal assembly relative to a second portion of the main body of the seal assembly; and removing the seal assembly from the horizontal tubing spool tree without removing the hanger from the horizontal tubing spool tree.

11. The method of claim 10, wherein positioning the seal assembly within the annular region between the hanger and the horizontal tubing spool tree of the mineral extraction system comprises engaging a first threaded portion of the seal assembly with a second threaded portion of the hanger.

12. The method of claim 10, wherein positioning the seal assembly within the annular region between the hanger and the horizontal tubing spool tree of the mineral extraction system comprises landing the seal assembly against a load ring of the hanger.

13. The method of claim 10, comprising locking the hanger within the horizontal tubing spool tree by engaging a locking ring of the hanger with a recess of the horizontal tubing spool tree.

14. The method of claim 10, comprising aligning a production flow port of the seal assembly with the production flow bore of the horizontal tubing spool tree, wherein aligning the production flow port of the seal assembly with the production flow bore of the horizontal tubing spool tree comprises engaging an alignment slot of the seal assembly with an alignment pin of the hanger.

15. The method of claim 10, comprising independently setting the first and second annular seals within the annular region by shearing a first shear pin of the first annular seal to radially expand the first annular seal and engage the first annular seal with the hanger and the horizontal tubing spool tree and subsequently shearing a second shear pin of the second annular seal to radially expand the second annular seal and engage the second annular seal with the hanger and the horizontal tubing spool tree.

16. A seal assembly, comprising:

a main body comprising a production fluid port configured to align with a production fluid bore of a tubing spool of a mineral extraction system, wherein the main body comprises a first portion and a second portion, wherein the first portion is moveable relative to the second portion during installation and/or removal of the seal assembly in and/or from the mineral extraction system;

a first annular seal supported by the main body and disposed on a first side of the production fluid port; and a second annular seal supported by the main body and disposed on a second side of the production fluid port, wherein the seal assembly is configured to be disposed in an annular region between a hanger and the tubing spool of the mineral extraction system, the first annular seal and the second annular seal are configured to isolate the production fluid port from the annular region, and the seal assembly is configured to be removed from the tubing spool without the hanger.

17. The seal assembly of claim 16, wherein the first annular seal and the second annular seal comprise a metal-to-metal seal, a metal end cap seal, an elastomer seal, or any combination thereof.

18. The seal assembly of claim 16, wherein the first portion comprises a threaded portion of an inner diameter of the main body, the first portion is rotatable by a tool during installation and/or removal of the seal assembly in and/or from the mineral extraction system, the second portion comprises the first annular seal and the second annular seal, the second portion is not rotatable by the tool during installation and/or removal of the seal assembly in and/or from the mineral extraction system, and the main body comprises a plurality of ball bearings disposed between the first portion and the second portion to enable rotation of the first portion relative to the second portion.

19. The seal assembly of claim 16, wherein the main body comprises an alignment slot configured to engage with an alignment pin of the hanger, and wherein the alignment slot enables alignment of the production fluid port with the production fluid bore of the tubing spool.

20. The seal assembly of claim 16, wherein the seal assembly is configured to be manually or hydraulically threaded about the hanger.

* * * * *